US009124965B2

(12) United States Patent
Heiman et al.

(10) Patent No.: US 9,124,965 B2
(45) Date of Patent: Sep. 1, 2015

(54) ADAPTIVE SYSTEM FOR MANAGING A PLURALITY OF MICROPHONES AND SPEAKERS

(71) Applicant: DSP Group, Herzelia (IL)

(72) Inventors: Arie Heiman, Sde Warburg (IL); Uri Yehuday, Tel Aviv (IL); Roei Roeimi, Hagor (IL)

(73) Assignee: DSP Group LTD., Herzeliya (IL)

( * ) Notice: Subject to any disclaimer, the term of this patent is extended or adjusted under 35 U.S.C. 154(b) by 0 days.

(21) Appl. No.: 14/074,365

(22) Filed: Nov. 7, 2013

(65) Prior Publication Data

US 2014/0126729 A1 May 8, 2014

Related U.S. Application Data

(60) Provisional application No. 61/723,856, filed on Nov. 8, 2012.

(51) Int. Cl.

| | |
|---|---|
| ***H04R 29/00*** | (2006.01) |
| ***H04R 1/00*** | (2006.01) |
| ***H04R 3/00*** | (2006.01) |

(52) U.S. Cl.

CPC .. *H04R 1/00* (2013.01); *H04R 3/00* (2013.01); *H04R 2400/01* (2013.01); *H04R 2499/11* (2013.01)

(58) Field of Classification Search

CPC .. H04R 1/00; H04R 2400/01; H04R 2499/11; H04R 3/00

USPC ..... 381/56, 123, 17, 74, 71.1–71.6, 328, 381/110; 379/406.08; 370/276; 455/550.1

See application file for complete search history.

(56) References Cited

U.S. PATENT DOCUMENTS

| | | | | |
|---|---|---|---|---|
| 5,125,032 | A * | 6/1992 | Meister et al. | 381/72 |
| 6,173,058 | B1 * | 1/2001 | Takada | 381/66 |
| 7,072,476 | B2 * | 7/2006 | White et al. | 381/74 |
| 2011/0053636 | A1 * | 3/2011 | Park | 455/550.1 |
| 2014/0037100 | A1 * | 2/2014 | Giesbrecht | 381/71.8 |

* cited by examiner

*Primary Examiner* — Lun-See Lao

(74) *Attorney, Agent, or Firm* — Reches Patents

(57) ABSTRACT

Methods and systems are provided for adaptively managing a plurality of microphones and speakers in an electronic device. A mode of operation of the electronic device may be determined, and operation of at least one speaker may be managed, based on the determined mode of operation. The managing may comprise adaptively switching or modifying functions of the at least one speaker. For example, the at least one speaker may be configured to act as microphone or as vibration detector. Input obtained using the at least one speaker may be utilized in optimizing audio related functions, such as noise reduction and/or acoustic echo canceling.

18 Claims, 7 Drawing Sheets

ADAPTIVE SYSTEM FOR MANAGING A PLURALITY OF MICROPHONES AND SPEAKERS

CLAIM OF PRIORITY

This patent application makes reference to, claims priority to and claims benefit from the U.S. Provisional Patent Application Ser. No. 61/723,856, filed on Nov. 8, 2012, and having the title: "Adaptive System for Managing a Plurality of Microphones and Speakers." The above stated application is hereby incorporated herein by reference in its entirety.

TECHNICAL FIELD

Aspects of the present application relate to audio processing. More specifically, certain implementations of the present disclosure relate to an adaptive system for managing a plurality of microphones and speakers.

BACKGROUND

Existing methods and systems for managing audio input and output components (e.g., speakers and microphones) in electronic devices may be inefficient and/or costly. Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY

A system and/or method is provided for an adaptive system for managing a plurality of microphones and speakers, substantially as shown in and/or described in connection with at least one of the figures, as set forth more completely in the claims.

These and other advantages, aspects and novel features of the present disclosure, as well as details of illustrated implementation(s) thereof, will be more fully understood from the following description and drawings.

DETAILED DESCRIPTION

Certain implementations may be found in method and system for adaptively managing, controlling and switching the operation of a plurality of microphones and speakers in an electronic device (e.g., a mobile communication system, such as a mobile phone or tablet). In this regard, built-in microphones and speakers of electronic devices may be utilized, in accordance with the present disclosure, without changing the location of the microphones and speakers in the original structure of the device. Rather, operation of the microphones and speakers of electronic devices may be managed, controlled and switched, to support enhanced and/or optimized functionality within the electronic devices. For example, built-in speakers of a standard mobile device may be used, in combination with the signal processing capabilities of the device, including hardware and software, to provide input for use within the device. A built-in speaker may be configured and used as a microphone and/or a vibration detector, such as to provide reliable determination of whether a device user is talking or not, and/or for generating useful input and/or an indication for performing various adaptation processes. For example, the input or indication generated by the speaker may be utilized in improving noise reduction or acoustic echo canceling processes. The selection of the speaker and/or microphone to be used may be done automatically and adaptively, such as based on a mode of operation of the system.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first plurality of lines of code and may comprise a second "circuit" when executing a second plurality of lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "block" and "module" refer to functions than can be performed by one or more circuits. As utilized herein, the term "example" means serving as a non-limiting example, instance, or illustration. As utilized herein, the terms "for example" and "e.g.," introduce a list of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Figure 1:
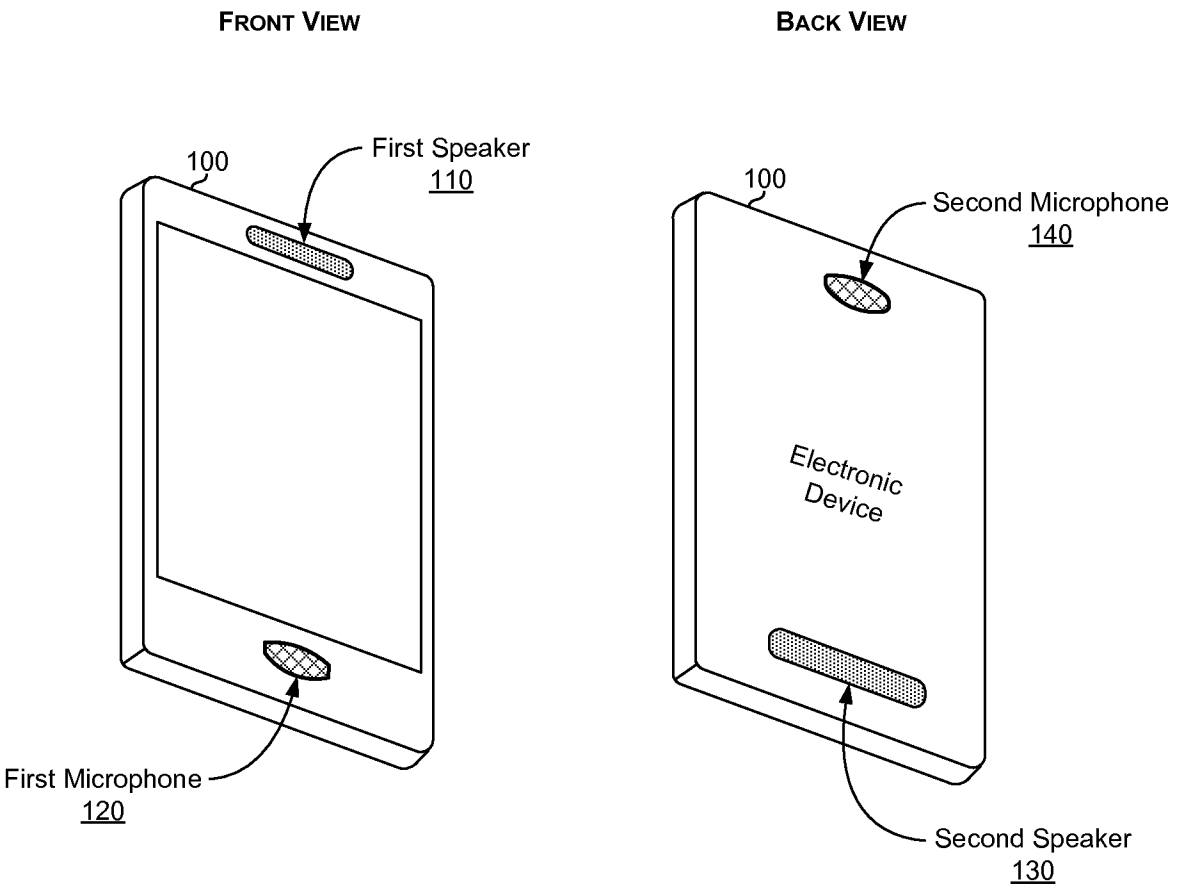
FIG. 1 illustrates an example electronic device with a plurality of microphones and speakers.

FIG. 1 illustrates an example electronic device with a plurality of microphones and speakers. Referring to FIG. 1, there is shown an electronic device 100.

The electronic device 100 may comprise suitable circuitry for performing or supporting various functions, operations, applications, and/or services. The functions, operations, applications, and/or services performed or supported by the electronic device 100 may be run or controlled based on user instructions and/or pre-configured instructions. In some instances, the electronic device 100 may support communication of data, such as via wired and/or wireless connections, in accordance with one or more supported wireless and/or wired protocols or standards. In some instances, the electronic device 100 may be a Handset mobile device—i.e., be intended for use on the move and/or at different locations. In this regard, the electronic device 100 may be designed and/or configured to allow for ease of movement, such as to allow it to be readily moved while being held by the user as the user moves, and the electronic device 100 may be configured to handle at least some of the functions, operations, applications, and/or services performed or supported by the electronic device 100 on the move. Examples of electronic devices may comprise mobile communication devices (e.g., cellular phones, smartphones, and tablets), personal computers (e.g., laptops or desktops), and the like. The disclosure, however, is not limited to any particular type of electronic device.

In an example implementation, the electronic device 100 may support input and/or output of audio. The electronic device 100 may incorporate, for example, a plurality of speakers and microphones, for use in outputting and/or inputting (capturing) audio, along with suitable circuitry for driving, controlling and/or utilizing the speakers and microphones. For example, the electronic device 100 may comprise a first speaker 110, a first microphone 120, a second speaker 130, and a second microphone 140. The manner by which the first speaker 110, the first microphone 120, the second speaker 130, and/or the second microphone 140 are utilized may be based on operation of the electronic device 100. Further, the electronic device 100 may support a plurality of operation modes, with corresponding (and typically differing) use profiles of the speakers and/or microphones. For example, where the electronic device 100 is (or is utilized as) a mobile communication device (e.g., a smartphone), the electronic device 100 may support (with respect to audio input/output) such modes as "Handset Mode" and "Speaker Mode."

In this regard, the Handset Mode may correspond to use of the electronic device 100 during voice calls, in which a user may hold the electronic device to the user's face (i.e., the electronic device 100 being used as 'phone' that is held in typical manner). For example, during Handset Mode, the first speaker 110 and the first microphone 120 may be utilized in support of voice calling services—i.e., the first speaker 110 may be an earpiece speaker while the first microphone 120 is utilized (being placed close to user's mouth) in capturing speech/audio input. In the Speaker Mode, the second speaker 130 (i.e. the non-earpiece speaker) may be used in outputting audio. The Speaker Mode may correspond to, for example, use of the electronic device 100 during voice calls, but in scenarios where the user may not hold the electronic device (e.g., the electronic device 100 is used as hands-free or speaker 'phone'). In this regard, when the electronic device 100 operates in Speaker Mode during hands-free voice calling, the second speaker 130 (i.e. the non-earpiece speaker) may be used in outputting audio and the second microphone 140 (being more suited for capturing ambient voices from distance) may be used in capturing speech/audio input. The Speaker Mode may also correspond to using the electronic device 100 in providing audio services that are unrelated to non-voice calling. For example, the second speaker 130 may operate in Speaker Mode when outputting music that is played in the electronic device 100. The speakers 110 and 130 may not work simultaneously—e.g., in Handset Mode, the primary (earpiece) speaker 110 may be activated and used while the second speaker 130 may be inactive and/or unused; whereas in Speaker Mode, the primary (earpiece) speaker 110 may not be active while the second speaker 130, which normally can produce higher speech power, is active.

In various implementations of the present disclosure, use and/or configuration of existing multiple microphones and speakers may be optimized in electronic devices (e.g., the electronic device 100) to enhance various audio related functions, such as by utilizing speakers that may typically be inactive in certain modes to capture or obtain input signals. Examples of audio related functions that may be enhanced by optimally utilizing existing multiple microphones and speakers present in devices in this manner may comprise noise reduction and/or echo cancellation.

For example, different techniques may be applied in order to improve the voice quality, since providing high quality voice communication is typically desired. One of the techniques used in improving voice quality is noise reduction (NR), which may allow reducing the ambient noise for the benefit of the users (particularly the other end user). In some instances, noise reduction techniques may be implemented based on use of multiple microphones. For example, where two microphones are used in the device, with one of the microphones being close to the user's mouth (and used to capture the user's voice) and the other microphone being placed somewhere else on the device (e.g., close to the ear and/or on the other side of the device), the first microphone may be used to pick up the user's voice and the ambient noise, while the second microphone may be used to mainly pick up the ambient noise. The two signals (from the two microphones) may be processed in order to generate a clean voice to be transmitted to the other party. In such an arrangement, the noise reduction may perform well if the noise is coherent and the noise that is picked up at the secondary microphone and the noise picked up by the primary microphone are correlated. However when non-coherent noise is present, such as reverberation noise, which is typically present in close places such as offices, the noise picked up by both microphones may not be highly correlated, which may degrade the noise reduction performance. The noise reduction performance may be significantly better, however, when using microphones that are close to each other (e.g., at a distance of 1-2 cm from one another), because the correlation between the noise picked up in both microphones may be significantly higher.

In some instances, different techniques of echo cancellation are also used in order to reduce the echo and to prevent the receiving side from hearing the echo of a user's own voice. The techniques of acoustic echo canceling (AEC) may be based on estimation of noise and echo in the environment of the device. Further, the estimations may be done continuously—e.g., during a call, such as by using various adaptation techniques. The adaptation techniques may be based on various considerations, such as whether the user is talking or not, as the user's voice may be interpreted as noise if the adaptation is done when the user is talking. Estimating whether the user is talking or not, to enhance the adaptation, may be done using various techniques. For example, with voice activation detector (VAD), captured signals may be analyzed to determine or estimate if the user is talking or not. Most of those techniques work well in cases that the ambient noise level is low—e.g., where the signal to noise ratio (SNR) is high. However, when the SNR is low (i.e., when the environmental noise level is high in comparison to the user's voice level), estimation processes may fail to detect if the user is talking or not, and as a result, the performance of the NR and AEC is significantly degraded.

The placement of the microphones and/or speakers, which may be optimal for defined operation modes, may not be optimal for the other audio related functions. For example, the microphones 120 and 140 may typically be placed (particularly in mobile communication devices) relatively far from each other—e.g., at the top and bottom at distance of 10-15 cm, and/or may be placed on opposing sides of the device. Such placement, however, may not be optimal for such audio related functions as noise reduction (NR) and acoustic echo canceling (AEC). A solution to this problem may be provided by adding more microphone(s) to be positioned relatively close to the already existing microphone(s). However, adding more microphone(s) may not be desirable for various reasons—e.g., added costs, device design restrictions or limitations, etc. Another solution may be adjusting placement of microphones and speakers to particularly improve performance with respect to these audio related functions. However, such adjusting may adversely affect the main uses of these microphones and/or speakers and/or may be impractical.

Accordingly, in various implementations, the existing multiple microphones and the speakers (e.g., speakers 110 and 130 and microphones 120 and 140 of the electronic device 100) may be configured to provide enhanced noise reduction (NR) and acoustic echo canceling (AEC) performance, without affecting use of the existing microphones and/or speakers, or requiring modifying placement thereof, which may be optimized for other (main) use purposes—e.g., voice calls, background audio playback, and/or stereo recording capabilities. For example, the existing multiple microphones (placed afar) and speakers may be configured to operate as a two close microphones based arrangement, such as in particular modes of operation (e.g., Handset Mode), to enable providing enhanced noise reduction performance and/or acoustic echo canceling. The two close microphones based arrangement may be achieved by using one or more speakers to provide the required microphone based functions. In other words, the speakers may be utilized as "microphones"—i.e., in capturing audio and/or generating input signals.

The speakers used may be automatically selected, such as according to the mode of operation. For example, the selected speakers may comprise a speaker that is otherwise inactive in that mode of operation. A selected speaker may be used as a vibration detector—e.g., to provide a reliable indication if the user is talking or not. The selected speaker can operate simultaneously as a speaker and as a vibration detector. A system implemented according to the present disclosure may be modular and/or may be valid for any architecture. The operation of speakers and microphones may be managed in order to optimally perform such audio related function as noise reduction and/or echo cancellation. The managing may comprise recognizing the mode of operation; indicating if a user is talking; automatically selecting a speaker according to the recognized mode of operation and/or according to the indication if the user is talking; switching the operation of the selected speaker to function as a microphone or as a vibration detector according to the recognized mode of operation of the mobile communication system and according to the indication of whether the user is talking.

While certain examples may refer to a mobile phone, other mobile communication systems as well as any suitable electronic system may be used as well. Furthermore, while some of examples described may disclose particular architectures, with a particular number of speakers and microphones, with particular arrangements thereof, and particular other components for managing their operations in particular manner, it should be understood that these examples are only set forth in order to provide a thorough understanding of the disclosure, and are not intended to limit the scope of the disclosure.

Figure 2:
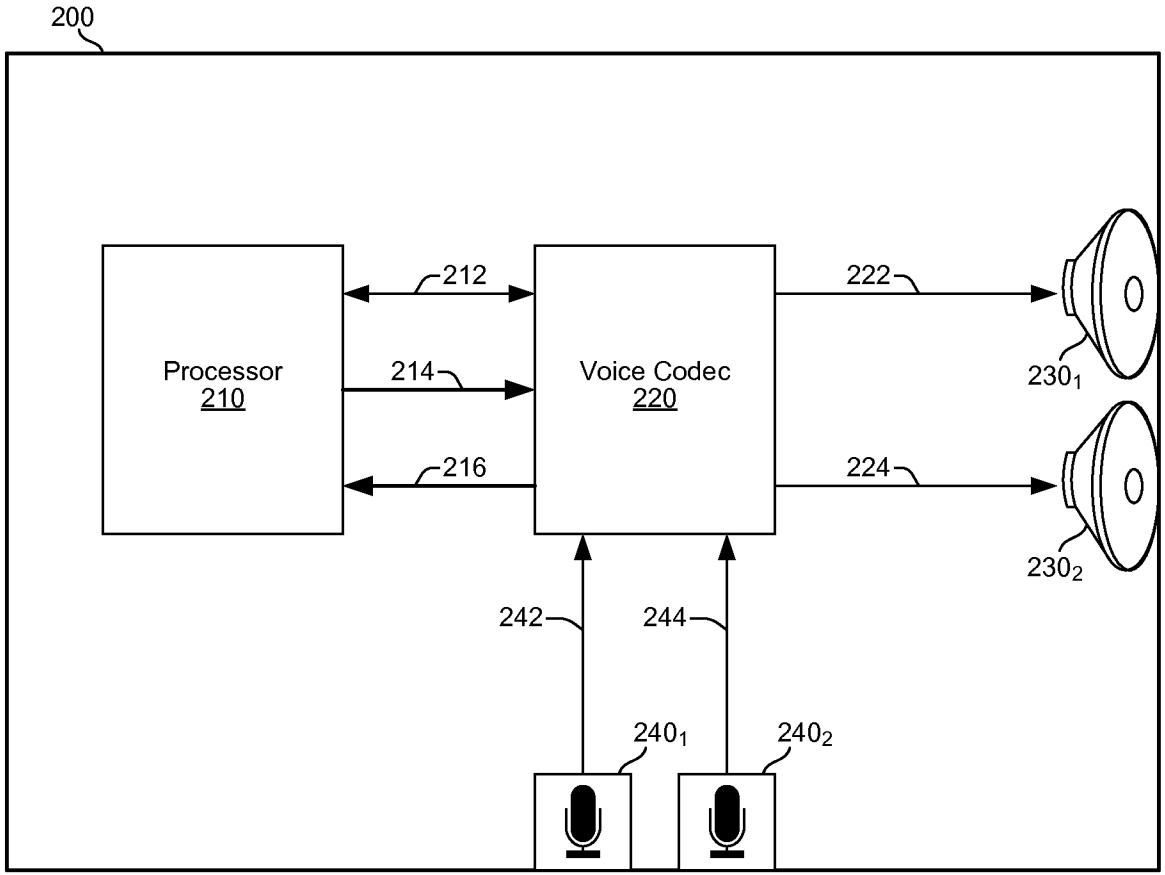
FIG. 2 illustrates architecture of an example electronic device with a plurality of microphones and speakers.

FIG. 2 illustrates architecture of an example electronic device with a plurality of microphones and speakers. Referring to FIG. 2, there is shown an electronic device 200.

The electronic device 200 may be similar to the electronic device 100 of FIG. 1, for example. In this regard, the electronic device 200 may incorporate a plurality of audio output components (e.g., speakers $\mathbf{230}_1$ and $\mathbf{230}_2$) and audio input components (e.g., microphones $\mathbf{240}_1$ and $\mathbf{240}_2$). The electronic device 200 may also incorporate circuitry for supporting audio related processing and/or operations. For example, the electronic device 200 may comprise a processor 210 and a voice codec 220.

The processer 210 may comprise suitable circuitry configurable to process data, control or manage operations (e.g., of the electronic device 200 or components thereof), perform tasks and/or functions (or control any such tasks/functions). The processor 210 may run and/or execute applications, programs and/or code, which may be stored in, for example, memory (not shown) internally to or externally of the processor 210. Further, the processor 210 may control operations of electronic device 200 (or components or subsystems thereof) using one or more control signals. The processer 210 may comprise a general purpose processor, which may be configured to perform or support particular types of operations (e.g., audio related operations). The processer 210 may also comprise a special purpose processor. For example, the processor 210 may comprise a digital signal processor (DSP), a baseband processor, and/or an application processor (e.g., ASIC).

The voice codec 220 may comprise suitable circuitry configurable to perform voice coding/decoding operations. For example, the voice codec 220 may comprise one or more analog-to-digital converters (ADCs), one or more digital-to-analog converters (DACs), and at least one multiplexer (MUX), which may be used in directing signals handled in the voice codec 220 to appropriate input and output ports thereof.

In operation, the electronic device 200 may support inputting and/or outputting of voice signals. For example, the microphone $\mathbf{240}_1$ and $\mathbf{240}_2$ may receive analog voice input, which may then be forwarded (as analog signals 242 and 244) to the voice codec 220. The voice codec 220 may convert the analog voice input (e.g., via the ADCs) to a digital voice stream, which may be transferred to the processor 210 (via a digital signal 216—e.g., over $I^2S$ connection). The processor 210 may then apply digital processing to the digital voice signals. On the output side, the processor 210 may generate digital voice signals, with the corresponding digital voice stream being transferred to the voice codec 220 (via a digital signal 214—e.g., over $I^2S$ connection). The voice codec 220 may process the digital voice stream, converting it (via the DACs) to analog signals, which may be fed to the speakers $\mathbf{230}_1$ and $\mathbf{230}_2$ (via analog connections 222 and 224).

In an example embodiment, the voice output signals may only be fed to one of the speakers. For example, the electronic device 200 may support a plurality of modes, including Handset Mode and Speaker Mode. Accordingly, the voice output signals may only be fed to the speaker $\mathbf{230}_1$ (which may be utilized as 'primary speaker') when the electronic device 200 is operating in Handset Mode; and may only be fed to the speaker $\mathbf{230}_2$ (which may be utilized as 'secondary speaker') when the electronic device 200 is operating in Speaker Mode. The switching between the two speakers may be done using the MUX of the voice codec 220. Further the switching may be controlled using the control signal 212 (which may be set based on the mode of operation).

In some instances, it may be desirable to utilize audio output components (e.g., speakers $\mathbf{230}_1$ and $\mathbf{230}_2$ of the electronic device 200) to obtain or generate audio input, which may be utilized in optimizing or enhancing audio related functions, such as noise reduction and/or acoustic echo canceling. For example, in instances when a user is using an electronic device in certain voice related services (e.g., the device may be a mobile phone, which the user may be using during a voice call), the device (or a casing of the device) may be in contact with user's cheek. The user's speech (i.e., voice)

may cause the user's bones to vibrate, which in turn may causes the casing of the device to vibrate, due to the fact that it is in contact with the user's cheek. Because speaker(s) of the device may typically be attached to the casing, a speaker may be utilized as vibration detector (VSensor), to sense vibrations in the casing, including vibrations caused by the user's voice—i.e., the speaker may be used in generating VSensor signals. Analyzing the VSensor signals it may be determined whether the user is talking or not. Further, the VSensor signals (in some instances in conjunction with signals obtained via standard microphones) may be processed, such as for improving the noise reduction and/or acoustic echo canceling processes. While use of speakers in this manner may be more pertinent in certain modes of operation (e.g., in Handset Mode), the disclosure is not so limited, and speakers may be used in similar manner in other modes of operations which may not typically be associated with the user talking (e.g., in Speaker Mode). For example, even in Speaker Mode, if the device is close to the user's mouth, when the user talks, the user's voice may still cause the casing of the device to vibrate. Such vibration may be detected by a speaker that is not typically active during the present mode of operation—e.g., the 'earpiece' speaker, which may not typically be used during such modes as Speaker Mode, may be configured and/or acting as a vibration detector (VSensor), capturing these vibrations.

Supporting use of speakers to obtain audio input (e.g., as microphones or vibration detectors) may entail adding or modifying existing components (circuitry and/or software) in the electronic device. Nonetheless, these changes may be minimal and substantially more cost-effective than adding more dedicated audio input components. Examples of implementations supporting such use of speakers are provided in, at least, FIGS. 3, 4 and 5.

Figure 3:
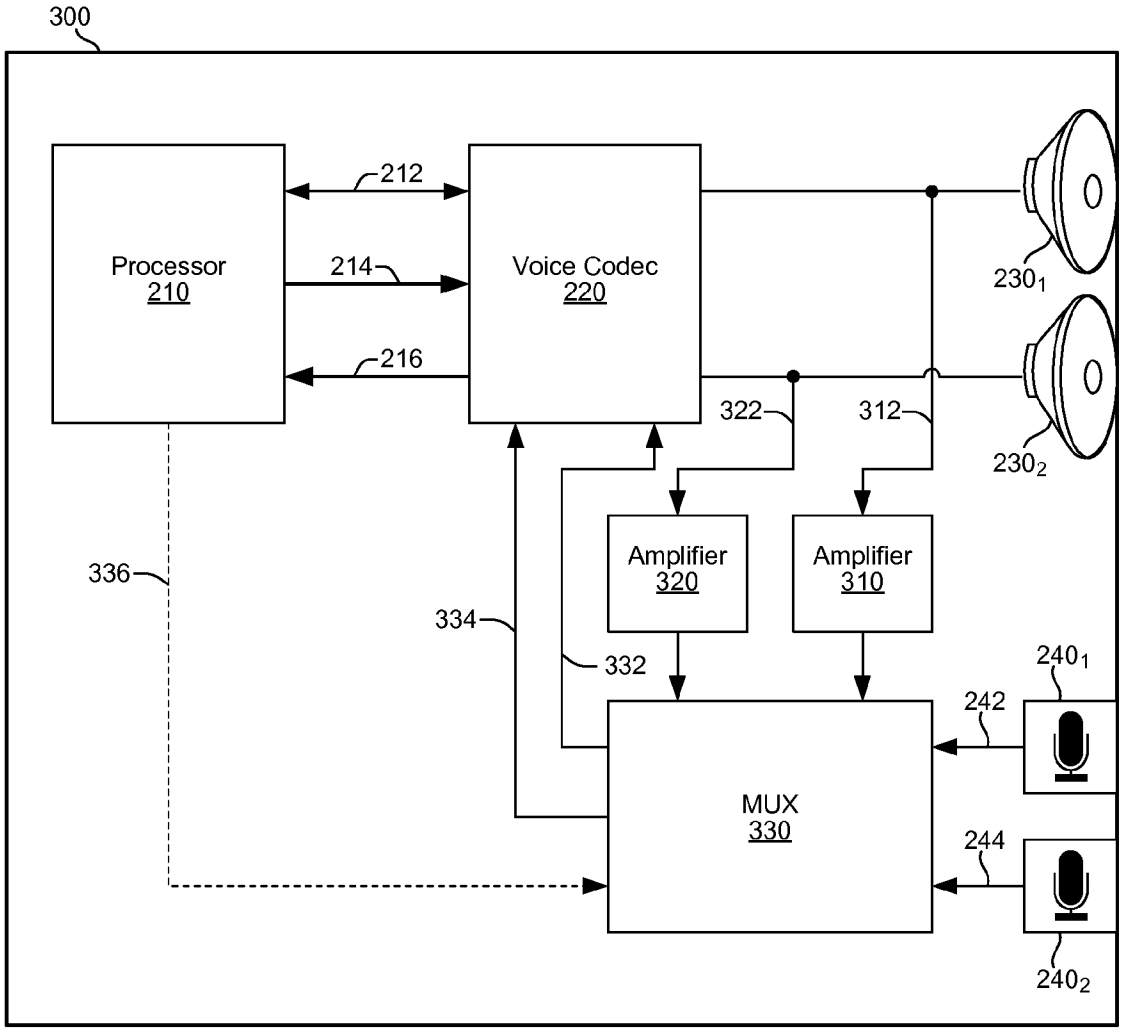
FIG. 3 illustrates architecture of an example electronic device with a plurality of microphones and speakers, which is modified to enable use of speakers as audio input components.

FIG. 3 illustrates architecture of an example electronic device with a plurality of microphones and speakers, which is modified to enable use of speakers as audio input components. Referring to FIG. 3, there is shown an electronic device 300.

The electronic device 300 may be substantially similar to the electronic device 200 of FIG. 2, for example. The electronic device 300, however, may be configured to support utilizing audio output components (e.g., speakers) as audio input components (e.g., microphones or vibration detectors), such as to enhance certain audio related functions (e.g., noise reduction and/or acoustic echo canceling). The electronic device 300 may comprise additional circuitry and/or components—i.e., in addition to the circuitry and/or components described with respect to the electronic device 200—for supporting such optimized use of speakers. For example, in the implementation shown in FIG. 3, the electronic device may comprise a multiplexer (MUX) 330 and a pair of amplifiers 310 and 320. The MUX 330 and amplifiers 310 and 320 may be utilized in obtaining inputs from the speakers $\mathbf{230}_1$ and $\mathbf{230}_2$ (via connections 312 and 322), and feeding the input(s) into the voice codec 220. The input(s) from the speakers $\mathbf{230}_1$ and $\mathbf{230}_2$ may be utilized in enhancing and/or optimizing such audio related functions as noise reduction and/or acoustic echo canceling. In this regard, use of input from speakers $\mathbf{230}_1$ and $\mathbf{230}_2$ may be desirable because of their placement in electronic device 300—e.g., being spaced at preferable distance when capturing inputs (e.g., close to one of the microphones $\mathbf{240}_1$ and $\mathbf{240}_2$), or attached to the casing of the electronic device 300, thus providing ideal positioning for serving as vibration detectors.

In operation, speakers $\mathbf{230}_1$ and $\mathbf{230}_2$ may be configured and/or utilized as input devices (i.e., for obtaining audio or vibration input). In an example use scenario, one or of the speakers $\mathbf{230}_1$ and $\mathbf{230}_2$ may be selected for use in obtaining 'microphone' input, which may be processed, such as in conjunction with input from a standard microphone (i.e., one or both of the microphones $\mathbf{240}_1$ and $\mathbf{240}_2$) during noise reduction and/or acoustic echo canceling processes. The processor 210 may instruct the MUX 330 (e.g., via control signal 336) to select input from one of the speakers $\mathbf{230}_1$ and $\mathbf{230}_2$ and one or more of the microphones $\mathbf{240}_1$ and $\mathbf{240}_2$, to operate as two close microphones. The particular pair of speaker/microphone to be utilized in this manner may be selected automatically and/or adaptively, such as based on the mode of operation of the electronic device 300.

For example, in Handset Mode, where the speaker $\mathbf{230}_1$ may be utilized (e.g., as the 'earpiece' speaker), the processor 210 may instruct, via control signal 336, the MUX 330 to select inputs from microphone $\mathbf{240}_1$ (being used as the primary microphone) and from speaker $\mathbf{230}_2$. Further, the processor 210 may configure the speaker $\mathbf{230}_2$, which is not active as a speaker during the Handset Mode, for use as microphone—e.g., providing input supporting NR and/or AEC processes. For example, the speaker $\mathbf{230}_2$ may be configured to generate an input signal by using, e.g., the same components that are otherwise used in generating output audio, but configured to function in a reverse manner. Further, the generated signals may be amplified, via the amplifier 320, before being fed into the MUX 330. Accordingly, the selected signals from the components that act as close microphones (i.e., microphone $\mathbf{240}_1$ and speaker $\mathbf{230}_2$) may be fed (via analog connections 332 and 334) to voice codec 220, for digitization thereby. The corresponding digital signals may then be fed (as digital signal 216), to the processor 210 for further processing.

In Speaker Mode, where the speaker $\mathbf{230}_2$ may be utilized (e.g., as the 'non-earpiece' speaker), the processor 210 may instruct, via control signal 336, the MUX 330 to select inputs from microphone $\mathbf{240}_2$ (being used as the primary microphone) and from speaker $\mathbf{230}_1$. The processor 210 may configure the speaker $\mathbf{230}_1$, which is not active as a speaker during the Speaker Mode, for use as microphone, as described above. Thus, the microphone $\mathbf{240}_2$ and the speaker $\mathbf{230}_1$ may act as close microphones, and signals inputted therefrom into the MUX 330 (after amplification of signals generated by the speaker $\mathbf{230}_k$ via amplifier 310) may be fed by the MUX 330 into the voice codec 220 (via connections 332 and 334) for digitization, with the corresponding digital results being fed to the processor 210 for further processing.

The processor 210 may be configured to perform additional steps when handling the inputs signals, to account for the source of the input signal. For example, because frequency response of the standard microphones (e.g., microphones $\mathbf{240}_1$ and $\mathbf{240}_2$) is typically different from the frequency response of speakers (e.g., speakers $\mathbf{230}_1$ and $\mathbf{230}_2$) acting as microphones, the processor 210 may carry out pre-processing of signals from a speaker acting as microphone to better match the input signals originating from a standard microphone. An example of a pre-processing path for matching signals from speaker to those of a standard microphone is described in more detail in FIG. 5.

Figure 4:
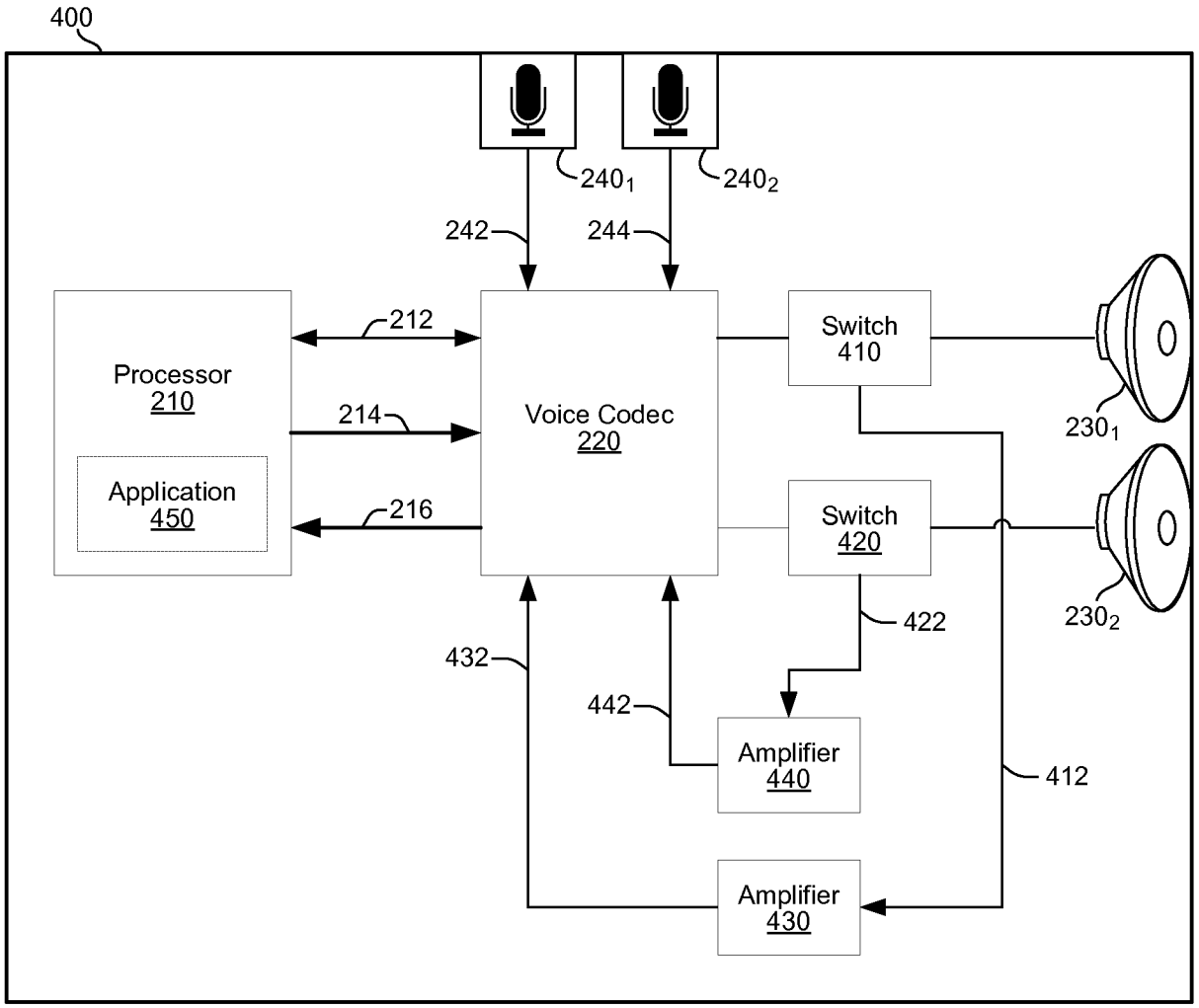
FIG. 4 illustrates architecture of an example electronic device with a plurality of microphones and speakers, which is modified in an alternate manner to enable use of speakers as audio input components.

FIG. 4 illustrates architecture of an example electronic device with a plurality of microphones and speakers, which is modified in an alternate manner to enable use of speakers as audio input components. Referring to FIG. 4, there is shown an electronic device 400.

The electronic device 400 may be substantially similar to the electronic device 200 of FIG. 2, for example. As with the electronic device 300 of FIG. 3, however, the electronic device 400 may also be configured to support utilizing audio output components (e.g., speakers) as audio input components (e.g., microphones or vibration detectors), such as to enhance certain audio related functions (e.g., noise reduction and/or acoustic echo canceling). The electronic device 400 may comprise additional circuitry and/or components—i.e., in addition to the circuitry and/or components described with respect to the electronic device 200—for supporting such optimized use of speakers. For example, in the implementation shown in FIG. 4, the electronic device may comprise a pair of switches 410 and 420, and a pair of amplifiers 430 and 440. Each of the switches 410 and 420 may comprise circuitry for allowing adaptive routing of signals, such as based on the input port on which the signals are received. For example, the switches 410 and 420 may be configurable to forward signals from the voice codec 220 (i.e., 'output' signals) to the speakers $\mathbf{230}_1$ and $\mathbf{230}_2$, and to forward signals obtained from the speakers $\mathbf{230}_1$ and $\mathbf{230}_2$ (i.e., 'input' signals) to the amplifiers 430 and 440. The switches 410 and 420 and the amplifiers 430 and 440 may be utilized in obtaining inputs from the speakers $\mathbf{230}_1$ and $\mathbf{230}_2$, and feeding the input(s) into the voice codec 220. As described, the input(s) from the speakers $\mathbf{230}_1$ and $\mathbf{230}_2$ may be utilized in enhancing and/or optimizing such audio related functions as noise reduction and/or acoustic echo canceling.

In operation, speakers $\mathbf{230}_1$ and $\mathbf{230}_2$ may be configured and/or utilized as input devices (i.e., for obtaining audio or vibration input). In an example use scenario, one (or both) of the speakers $\mathbf{230}_1$ and $\mathbf{230}_2$ may be selected and configured as VSensor, for use in sensing vibration and generating corresponding 'vibration' input, which may be processed, such as in conjunction with input from a standard microphone (i.e., one of the microphones $\mathbf{240}_1$ and $\mathbf{240}_2$) during noise reduction and/or acoustic echo canceling processes. The particular speaker to be used as VSensor may be selected automatically and/or adaptively, such as based on the mode of operation of the electronic device 400.

For example, in Handset Mode, where speaker $\mathbf{230}_1$ may be activated and used as primary speaker whereas speaker $\mathbf{230}_2$ may typically not be activated nor used in supporting voice calling services. Thus, the speaker $\mathbf{230}_2$ may be selected when the electronic device 400 is in Handset Mode and may be configured as VSensor. The speaker $\mathbf{230}_2$ may generate (e.g., when electronic device 400 is subjected to some vibration) VSensor signals which may be routed via switch 420 to the amplifier 440 (over connection 422), which may amplify the signals, and then feed the signals to the voice codec 220 (via connection 442). The voice codec 220 may process the signals (e.g., applying conversion via its ADCs), with the resulting digital signals being fed (as digital signal 216) to the processor 210, for processing thereof. In some instances, the processor 210 may incorporate a dedicated application module 450 (e.g., software module), which may be configurable to analyzes incoming VSensor signals. For example, the analysis of the VSensor signals may enable detecting if the corresponding vibration indicates that a device's user is talking.

In Speaker Mode, where speaker $\mathbf{230}_2$ may be activated and used as primary speaker whereas speaker $\mathbf{230}_1$ may typically not be activated nor used, the speaker $\mathbf{230}_1$ may be selected instead and may be configured as VSensor. The switch 410 may then route any VSensor signals generated by the speaker $\mathbf{230}_1$ to the amplifier 430 (over connection 412), which may amplify the signals, and then feed the signals to the voice codec 220 (via connection 432). The signals may then be handled in similar manner as described above with respect to the Headset Mode.

In some implementations, a speaker may be configured as VSensor and simultaneously used as such (i.e., in generating VSensor signals) while active and being used as a speaker. For example, in Speaker Mode, where speaker $\mathbf{230}_2$ may typically be activated and used as primary speaker, the speaker $\mathbf{230}_1$ may still be configured as VSensor. The switch 420 may then be configured to route signals in both directions if necessary—i.e., route 'output' signals received from the voice codec 220 to the speaker $\mathbf{230}_2$ while also routing 'input' VSensor signals received from the speaker $\mathbf{230}_1$ to the amplifier 440.

Figure 5:
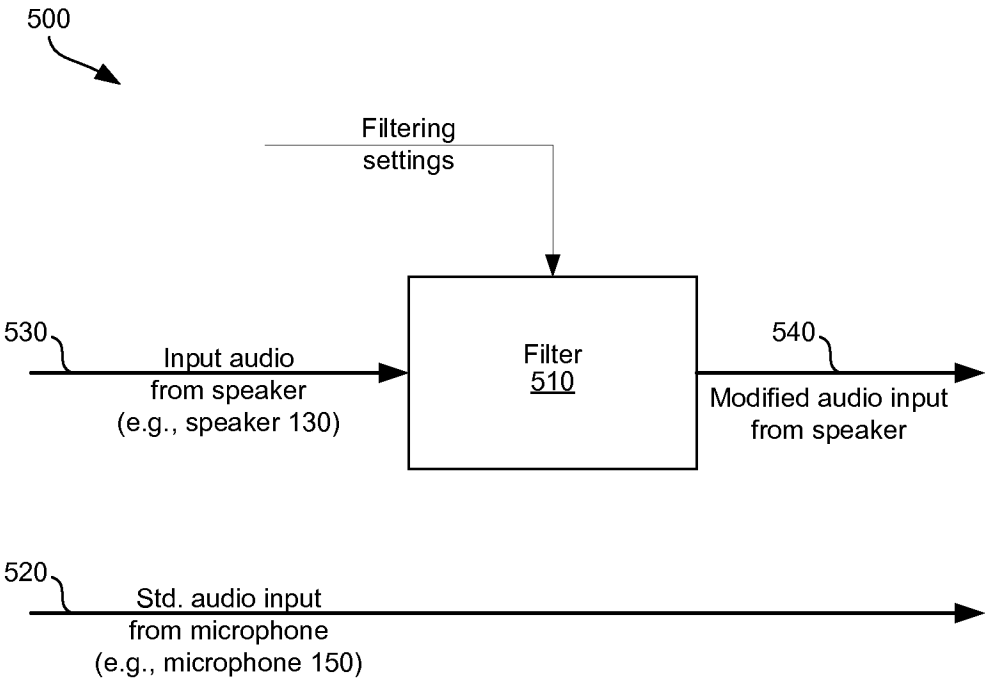
FIG. 5 illustrates an example of pre-processing for converting signals obtained from a speaker to match signals from a standard microphone, for use in conjunction with standard audio signals obtained via a microphone.

FIG. 5 illustrates an example pre-processing for converting signals obtained from a speaker to match signals from standard microphone, for use in conjunction with standard audio signals obtained via a microphone. Referring to FIG. 5, there is shown a pre-processing path 500.

The pre-processing path 500 may be part of a processing circuitry in an electronic device (e.g., the processor 210), configured to handle processing of audio in the electronic device. Specifically, the pre-processing path 500 may be configured to support handling of audio input signals that are obtained from audio output components (e.g., speakers or the like), to enable use thereof in conjunction with audio input from standard audio input components (e.g., standard microphones).

In the example implementation shown in FIG. 5, the pre-processing path 500 may handle a (standard) input signal 520 received from a standard microphone (e.g., one of the microphones $\mathbf{240}_1$ and $\mathbf{240}_2$) and an input audio signal 530 received from a speaker (e.g., one of the speakers $\mathbf{230}_1$ and $\mathbf{230}_2$) configured to act as a microphone. The pre-processing path 500 may then process the speaker input signal 530, generating a corresponding (modified) signal 540 in a manner to ensure that the corresponding (modified) signal 540 may properly match the (standard) input signal 520. For example, the speaker input signal 530 may undergo, within the pre-processing path 500, filtering (e.g., via a filter 510) to guarantee that the frequencies of signals 520 and 540 are similar. In this regard, the filter 510 may comprise suitable circuitry for providing signal filtering. The filter 510 may be configured to ensure that the signals converted properly, in a manner that may ensure that signals corresponding to speaker input match standard microphone input.

For example, the filter 510 may be implemented as a finite impulse response (FIR) filter, whose phase is linear, in order not to destroy the phase of the filtered signal. Further, the FIR filter may be designed such that the spectrum of processed Speaker signal (i.e., filtered signals 540) will be close to the spectrum of the microphone signal (i.e., signal 520). For example, assuming S(f) corresponds to speaker as a microphone spectrum and $S_M(f)$ is spectrum of the standard microphone, the filter 510 may be configured such that the filtering performed thereby would ensure that spectrum of a processed signal—i.e., S(f))*FIR(f), will be close to the spectrum $S_M(f)$ of the microphone spectrum. Thus, the frequency response of the filter 510 may be configured to be $FIR(f)=S_M(f)/S(f)$. Accordingly, the (FIR) filter 510 configured in this manner may provide the signal filtering in a fixed manner, resulting in the difference between the transfer functions of the standard microphone and the speaker acting as a microphone.

The filtering function of the filter 510 may be controlled using filtering parameters, which may be determined based on, e.g., a calibration process. The calibration process may be done once to define the filtering parameters—which may then be stored and reused thereafter. The calibration process may also be performed repeatedly and/or dynamically (e.g., in real-time). The filtering functions (and thus corresponding filtering parameter) may differ based on the source of the signals. For example, the filtering parameters may differ when the to-be-filtered signal originates from the speaker $\mathbf{230}_1$ rather than from the speaker $\mathbf{230}_2$. Thus, different sets of filtering parameters may be predetermined for the different (available) speakers, with the suitable speaker being selected based on the source in each use scenario. The signals 520 and 540 may then be utilized as two 'microphone' signals—e.g., in any two-microphone noise reduction (NR) operations.

Figure 6:
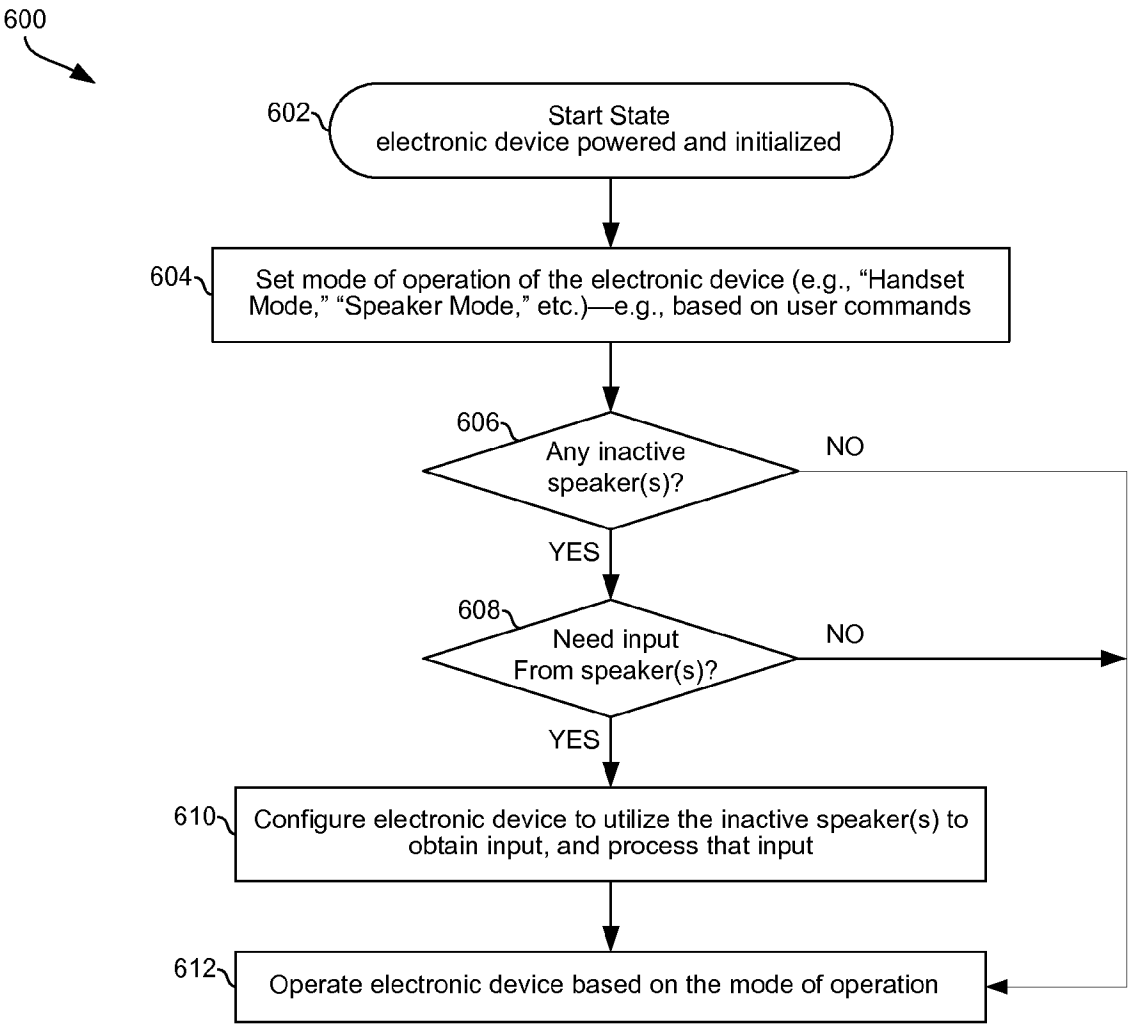
FIG. 6 is a flowchart illustrating an example process for managing multiple microphones and speakers in an electronic device.

FIG. 6 is a flowchart illustrating an example process for managing multiple microphones and speakers in an electronic device. Referring to FIG. 6, there is shown a flow chart 600, comprising a plurality of example steps, which may executed in an electronic system (e.g., the electronic device 300 or 400 of FIGS. 3 and 4), to facilitate optimal management of speakers and microphones incorporated therein.

In starting step 602, an electronic device (e.g., the electronic device 300) may be powered on and initialized. This may comprise powering on, activating and/or initializing various components of the electronic device, so that the electronic device may be ready to perform or execute functions or application supported thereby.

In step 604, the mode of operation of the electronic device may be set (or switched to), such as based on user command/input or previously configured execution instruction(s). For example, in instances where the electronic device may support communication (particularly voice calling) services, modes of operation may comprise Handset Mode and/or Speaker Mode. Accordingly, the electronic device may switch to the Handset Mode when a device's user initiated (or accepts) a voice call, and places the electronic device to the user's face.

In step 606, it may be determined whether there are any inactive speakers based on the present mode of operation. For example, in mobile communication devices (e.g., mobile phones) having multiple speakers, only certain speaker(s) may be utilized in certain modes of operations—e.g., only the 'earpiece' speaker in Handset Mode. In instances where it is determined that are no speakers inactive (or unused) speakers, the process may proceed to step 612; otherwise the process proceeds to step 608.

In step 608, it may be determined whether there is a need to configure an inactive (or unused) speaker to provide input. For example, in electronic devices having multiple microphones, sometimes the microphones may be used to obtain input for support of such functions as noise reduction and acoustic echo canceling. Performance of these functions, however, may be degraded if the used microphones are not optimally placed (e.g., too far apart). Thus, where a speaker is more optimally placed relative to one of the microphones, it may be more desirable to use that speaker as 'microphone.' Also, it may be desirable to utilize a speaker as vibration detector (VSensor)—e.g., when it is placed ideally to receive vibrations propagating through the user's bones and into the electronic device (or casing thereof). In instances where it is determined that there is no need to configure an inactive (or unused) speaker to provide input, the process may proceed to step 612; otherwise the process proceeds to step 610.

In step 610, one or more selected speakers (e.g., based on being inactive/unused, as determined based on the present mode of operation, and/or based on being best suited for providing desired input) may be configured to provide the desired input (e.g., as a 'microphone' capturing ambient audio or as VSensor capturing vibration propagating onto the electronic device). Further, the electronic device as a whole may be configured to support use of the selected speaker(s) in providing the input—e.g., activating the necessary components (amplifiers, MUXs, switching elements, etc.) to route and process the generated input.

In step 612, the electronic device may operate in accordance with the present mode of operation. This may comprise utilizing input obtained via any selected speaker(s)—e.g., to enhance noise reduction and/or acoustic echo canceling processes.

Figure 7:
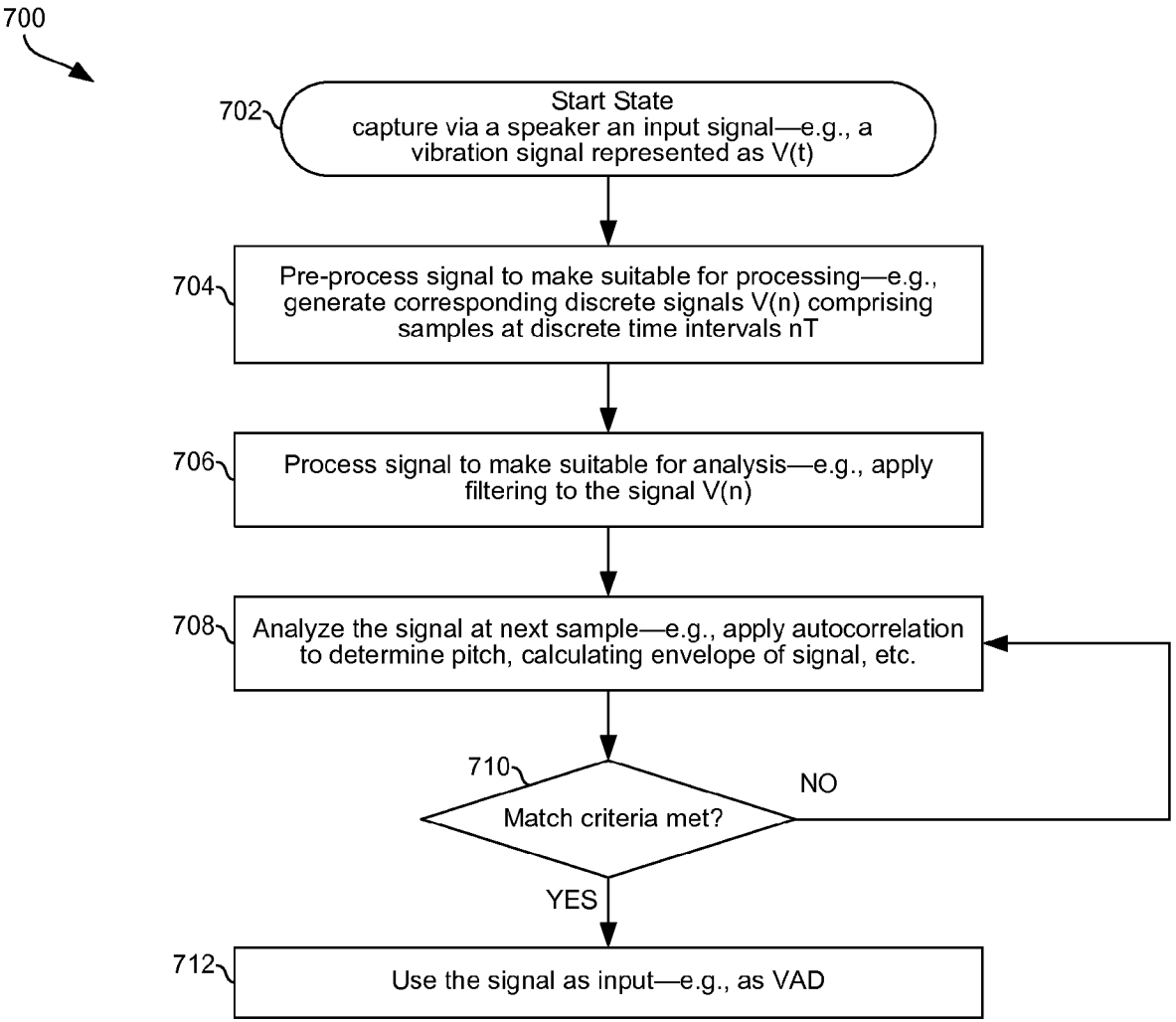
FIG. 7 is a flowchart illustrating an example process for generating audio input using a vibration captured via a speaker.

FIG. 7 is a flowchart illustrating an example process for generating audio input using a vibration captured via a speaker. Referring to FIG. 7, there is shown a flow chart 700, comprising a plurality of example steps. The plurality of example steps may correspond to and/or be performed in accordance with an algorithm—e.g., implemented via the application module 450.

In a starting step 702, a signal may be captured via a speaker. The signal, V(t), may, for example, correspond to vibration captured via the speaker. In step 704, the signal may be pre-processed—e.g., to generate corresponding discrete signal V(n), where 'n' corresponds to a sample of the signal V(t) at discrete time nT. Such signal V(n) may be sensitive to speech vibrations but may be significantly less sensitive to the ambient noise, especially for the low frequencies (e.g., up to approximately 1 kHz). Thus, even in a noisy environment the signal-to-noise ratio (SNR) may be relative high.

In step 706, the signal may be processed to make it suitable for analysis. For example, the signal V(n) may be filtered (e.g., using a band-pass filter or BPF).

In step 708, the signal may be processed. For example, a $V_{BP}(n)$ signal (resulting from filtering V(n) signal) may be processed sample by sample, using one or more analysis techniques. The $V_{BP}(n)$ signal may be analyzed using standard techniques, such as autocorrelation to calculate the pitch (e.g., of talking person). The $V_{BP}(n)$ signal can also be analyzed by calculating the envelope, $V_{EN}(n)$, of the signal.

In step 710, the outcome of the analysis may be checked, to determine if any match criteria is met. In instances where it may be determined that no match criteria is met, the process may loop back to step 708—to analyze the next sample. In instances where it may be determined that at least one match criteria is met—i.e., indicating that the person is talking, the process may proceed to step 712, where the signal may be utilized as input audio signal—e.g., as voice activation detector (VAD).

For example, the check performed in step 710 may comprise determining if a pitch was detected, and/or if the envelope of the signal is above a predefined threshold—e.g., $V_{EN}(n)>TH_env$.

The pitch detection may be done based on calculating of pitch value, by analyzing the autocorrelation of the input signal, and checking its maximum value against a predefined threshold. Thus, if the calculated maximum value (Auto_max) is above a predefined threshold (TH_pitch) the signal may be declared as voice signal.

Thus, in instances where Auto_max>TH_pitch, or where Auto_max<TH_pitch but $V_{EN}(n)>TH_env$, the signal may be declared as a Voice frame and the VAD flag may be set on. In other cases, however, the VAD flag will be set off.

In the example process shown in FIG. 7, the handling (calculation and/or analysis) of the signal is done on per-sample basis. Alternatively, however, the processing may be done on sets of samples. For example, each N samples ('N' being an integer) may be grouped into a frame and the calculation is done per each frame. The frame size may be adjusted for optimal performance. For example, each frame may be 10 ms (thus N would be set such that duration of each N samples is 10 ms).

In some implementations, a method for adaptively managing speakers and/or microphones may be utilized in a system that may comprise an electronic device (e.g., electronic device 300 or 400), which may comprise one or more circuits (e.g., processor 210, voice codec 220, switches 410 and 420, and amplifiers 310, 320, 430, and 440), and a first speaker and a second speaker (e.g., speakers $\mathbf{230}_1$ and $\mathbf{230}_2$). The one or more circuits may be operable to determine a mode of operation of the electronic device; and manage operation of one or both of the first speaker and the second speaker, based on the determined mode of operation, wherein the managing may comprise adaptively switching or modifying functions of the one or both of the first speaker and the second speaker. The switching or modifying of functions of the one or both of the first speaker and the second speaker may comprise configuring one of the first speaker and the second speaker for use as a microphone or as a vibration detector (VSensor). The one or more circuits may configure the one of the first speaker and the second speaker to simultaneously continue functioning as a speaker while also being used as a microphone or as a vibration detector. The one or more circuits may be operable to utilize input from the one of the first speaker and the second speaker configured for use as a microphone or as vibration detector to support audio enhancement functions in the electronic device. The audio enhancement functions may comprise noise reduction and/or acoustic echo canceling. The one of the first speaker and the second speaker may be configured as a vibration detector to indicate if a user of the electronic device is talking. The one of the first speaker and the second speaker may be configured as a vibration detector to detect vibration in a casing of the electronic device. The one or more circuits may be operable to select a different one of the first speaker and the second speaker according to a different mode of operation of the electronic device.

In some implementations, a method for adaptively managing speakers and microphones may be used in an mobile communication device comprising a first speaker and a second speaker (e.g., speakers $\mathbf{230}_1$ and $\mathbf{230}_2$), and a first microphone and a second microphone (e.g., microphones $\mathbf{240}_1$ and $\mathbf{240}_2$). The method may comprise determining a mode of operation of the mobile communication device; generating an indication when a user of the mobile communication device is talking; selecting one of the first speaker and the second speaker, based on the mode of operation of the mobile communication device and the indication that the user is talking; and managing operation of the selected speaker, based on the determined mode of operation. The managing may comprise determining when input from the first microphone and the second microphone is inadequate for supporting an audio enhancement function in the mobile communication device; and adaptively switching or modifying functions of the selected speaker, to obtain input through the selected speaker. The audio enhancement function may comprise noise reduction or acoustic echo canceling. The input from the first microphone and the second microphone may be determined to be inadequate for supporting the audio enhancement function in the mobile communication device based on placement of and/or spacing between the first microphone and the second microphone. The one of the first speaker and the second speaker may be selected based on placement and/or spacing relative to one or both of the first microphone and the second microphone.

Other implementations may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for adaptive system for managing a plurality of microphones and speakers.

Accordingly, the present method and/or system may be realized in hardware, software, or a combination of hardware and software. The present method and/or system may be realized in a centralized fashion in at least one computer system, or in a distributed fashion where different elements are spread across several interconnected computer systems. Any kind of computer system or other system adapted for carrying out the methods described herein is suited. A typical combination of hardware and software may be a general-purpose computer system with a computer program that, when being loaded and executed, controls the computer system such that it carries out the methods described herein. Another typical implementation may comprise an application specific integrated circuit or chip.

The present method and/or system may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form. Accordingly, some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. An adaptive system for managing a plurality of speakers, comprising:

an electronic device comprising one or more circuits, a first speaker and a second speaker that belong to the plurality of speakers, the one or more circuits being operable to:

determine, based upon a mode of operation of the electronic device, whether there is a certain speaker out of the first and second speakers that is unused during the mode of operation of the electronic device, and whether there is a need to configure the certain speaker to provide input; and configure the certain speaker to provide input if it is determined that there is a need to configure the certain speaker to provide input.

2. The system of claim 1, wherein the one or more circuits configure the certain speaker to provide the input when operating as a microphone or as a vibration detector.

3. The system of claim 1, wherein the one or more circuits configure the certain speaker to simultaneously continue functioning as a speaker while also being used as a microphone or as a vibration detector.

4. The system of claim 1, wherein the one or more circuits are operable to utilize input from the certain speaker configured for use as a microphone or as vibration detector to support audio enhancement functions in the electronic device.

5. The system of claim 4, wherein the audio enhancement functions comprise at least one out of noise reduction acoustic echo canceling.

6. The system of claim 1, wherein the certain speaker is configured as a vibration detector to indicate if a user of the electronic device is talking.

7. The system of claim 1, wherein the certain speaker is configured as a vibration detector to detect vibration in a casing of the electronic device.

8. The system of claim 1, wherein the electronic device is arranged to operate in a first mode of operation and in a second mode of operation;

wherein the one or more circuits are operable to determine, when the electronic device is set to operate at the first mode of operation in which the first speaker is unused, whether there is a need to configure the first speaker to provide input; and wherein the one or more circuits are operable to determine, when the electronic device is set to operate at the second mode of operation in which the second speaker is unused, whether there is a need to configure the second speaker to provide input.

9. A method for adaptively managing a plurality of speakers, the method comprising:

in an electronic device comprising a first speaker and a second speaker that belong to the plurality of speakers:

determining, based upon a mode of operation of the electronic device, whether there is a certain speaker out of the first and second speakers that is unused during the mode of operation of the electronic device, and whether there is a need to configure the certain speaker to provide input; and configuring the certain speaker to provide input if it is determined that there is a need to configure the certain speaker to provide input.

10. The method of claim 9, comprises configuring the certain speaker for use as a microphone or as a vibration detector.

11. The method of claim 9, comprising configuring the certain speaker to simultaneously continue functioning as a speaker while being used as a microphone or as a vibration detector.

12. The method of claim 10, comprising utilizing input from the certain speaker configured for used as microphone or as vibration detector to support audio enhancement functions in the electronic device.

13. The method of claim 12, wherein the audio enhancement functions comprise at least one out of noise reduction acoustic echo canceling.

14. The method of claim 9, comprising configuring the certain speaker as vibration detector to indicate if a user of the electronic device is talking.

15. The method of claim 9, comprising configuring the certain speaker as a vibration detector to detect vibration in a casing of the electronic device.

16. The method of claim 9, wherein the electronic device is arranged to operate in a first mode of operation and in a second mode of operation;

wherein the method comprises determining, when the electronic device is set to operate at the first mode of operation in which the first speaker is unused, whether there is a need to configure the first speaker to provide input; and determining, when the electronic device is set to operate at the second mode of operation in which the second speaker is unused, whether there is a need to configure the second speaker to provide input.

17. A non-transitory computer readable medium that stores a computer program that one executed by the computer causes the computer to perform the steps of: determining, based upon a mode of operation of an electronic device, whether there is a certain speaker out of the first and second speakers that is unused during the mode of operation of the electronic device, and whether there is a need to configure the certain speaker to provide input; and configuring the certain speaker to provide input if it is determined that there is a need to configure the certain speaker to provide input.

18. The non-transitory computer readable medium according to claim 1 wherein the electronic device is arranged to operate in a first mode of operation and in a second mode of operation; wherein the non-transitory computer readable medium stores instructions for determining when the electronic device is set to operate at the first mode of operation in which the first speaker is unused, whether there is a need to configure the first speaker to provide input; and determining, when the electronic device is set to operate at the second mode of operation in which the second speaker is unused, whether there is a need to configure the second speaker to provide input.

* * * * *